US007755557B2

(12) United States Patent
McGonigle et al.

(10) Patent No.: US 7,755,557 B2
(45) Date of Patent: Jul. 13, 2010

(54) CROSS-POLAR COMPENSATING FEED HORN AND METHOD OF MANUFACTURE

(75) Inventors: Neil McGonigle, Falkirk (GB); Craig Mitchelson, Carrickstowe (GB); David Geen, Peebles (GB); Graham Agnew, Livingston (GB)

(73) Assignee: Raven Antenna Systems Inc., Aurora, IL (US)

( * ) Notice: Subject to any disclaimer, the term of this patent is extended or adjusted under 35 U.S.C. 154(b) by 125 days.

(21) Appl. No.: 11/931,115

(22) Filed: Oct. 31, 2007

(65) Prior Publication Data

US 2009/0109111 A1 Apr. 30, 2009

(51) Int. Cl.
*H01Q 13/00* (2006.01)

(52) U.S. Cl. ..... 343/786; 343/772

(58) Field of Classification Search ..... 343/772, 343/786, 756; 333/21 A, 239
See application file for complete search history.

(56) References Cited

U.S. PATENT DOCUMENTS

| | | | | |
|---|---|---|---|---|
| 4,090,137 | A | 5/1978 | Soma et al. | |
| 4,398,200 | A | 8/1983 | Meier | |
| 4,499,473 | A | 2/1985 | Rao | |
| 4,564,952 | A | 1/1986 | Karabinis et al. | |
| 4,680,558 | A | 7/1987 | Ghosh et al. | |
| 4,700,195 | A | 10/1987 | Boan et al. | |
| 4,777,457 | A | 10/1988 | Ghosh et al. | |
| 4,922,213 | A | 5/1990 | Ghosh | |
| 5,359,339 | A | 10/1994 | Agrawal et al. | |
| 5,486,839 | A | 1/1996 | Rodeffer et al. | |
| 5,614,916 | A | 3/1997 | Mizuguchi | |
| 5,724,050 | A | 3/1998 | Tokunda et al. | |
| 5,796,370 | A | 8/1998 | Courtonne et al. | |
| 5,812,096 | A | 9/1998 | Tilford | |
| 5,903,241 | A | 5/1999 | Bhattacharyya | |
| 6,118,412 | A * | 9/2000 | Chen | 343/756 |
| 6,130,652 | A | 10/2000 | Goetz et al. | |
| 6,396,453 | B2 | 5/2002 | Amyotte et al. | |
| 6,441,795 | B1 | 8/2002 | Volman | |
| 6,549,173 | B1 | 4/2003 | King et al. | |
| 6,703,974 | B2 | 3/2004 | White et al. | |
| 6,720,932 | B1 | 4/2004 | Flyyn et al. | |
| 6,771,225 | B2 | 8/2004 | Tits | |
| 6,937,202 | B2 | 8/2005 | Chandler | |
| 6,943,744 | B1 | 9/2005 | Vezmar | |

(Continued)

OTHER PUBLICATIONS

Alan w. Rudge, Nurdin A. Adatia, "Offset-Parabolic-Reflector Antennas: A Review", Proceedings of IEEE vol. 66, No. 12, Dec. 1978, pp. 1592-1623, USA.

*Primary Examiner*—Hoang V Nguyen
(74) *Attorney, Agent, or Firm*—Babcock IP, PLLC

(57) ABSTRACT

A feed horn with a horn body and a waveguide body, each with a front end and a back end, respectively. The horn body and the waveguide body coupled together, the waveguide body front end to the horn body back end. The waveguide body provided with a waveguide bore between the front end and the back end. At least one slot formed in the waveguide bore parallel to a longitudinal axis of the body bore, the at least one slot extending to the front end. The horn body provided with a horn bore between the front end and the back end. The horn body and the waveguide body formable via injection molding methods such as die casting.

17 Claims, 4 Drawing Sheets

U.S. PATENT DOCUMENTS 6,982,679 B2 1/2006 Kralovec
6,995,726 B1 2/2006 West et al.
7,236,681 B2 6/2007 Moheb et al.
7,239,285 B2 7/2007 Cook
2002/0186174 A1 12/2002 Matsumoto et al.

* cited by examiner

CROSS-POLAR COMPENSATING FEED HORN AND METHOD OF MANUFACTURE

BACKGROUND

1. Field of the Invention

This invention relates to feed horns for reflector antennas. More particularly, the invention relates to a cost effective and electrically optimized cross-polarization interference compensating feed horn for an offset reflector antenna arrangement.

2. Description of Related Art

Reflector antennas may be configured in an offset arrangement where a sub reflector and or feed is located spaced away from a center point of a reflector target beam path. Although offset reflector antenna geometry minimizes beam interference that would otherwise be generated by the presence of the subreflector and or feed, it also generates an inherent cross-polarization within the non-symmetric plane.

U.S. Pat. No. 6,771,225 discloses an elliptical main reflector and one piece feed horn in an offset configuration. The one piece feed horn is formed with compensation slots in a waveguide section that are open to the horn end of the feed, the slot depths limited and the innermost step face angled in an electrical performance compromise to enable manufacture via a single die casting.

In addition to the electrical performance compromises made to enable manufacture via a single die casting, U.S. Pat. No. 6,771,225 requires the manufacture of a separate embodiment for every desired combination of feed position/orientation, main reflector geometry and or operating frequency(s). The required complex die molds, unique to each embodiment, significantly increases tooling, manufacturing and inventory costs.

Competition within the reflector antenna industry has focused attention on antenna designs that reduce antenna production costs but which still satisfy and or improve upon stringent electrical specifications, Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The inventor has recognized that a two component feed horn arrangement enables both cost effective manufacture of multiple embodiments and significant improvements to feed horn electrical performance.

Figure 1:
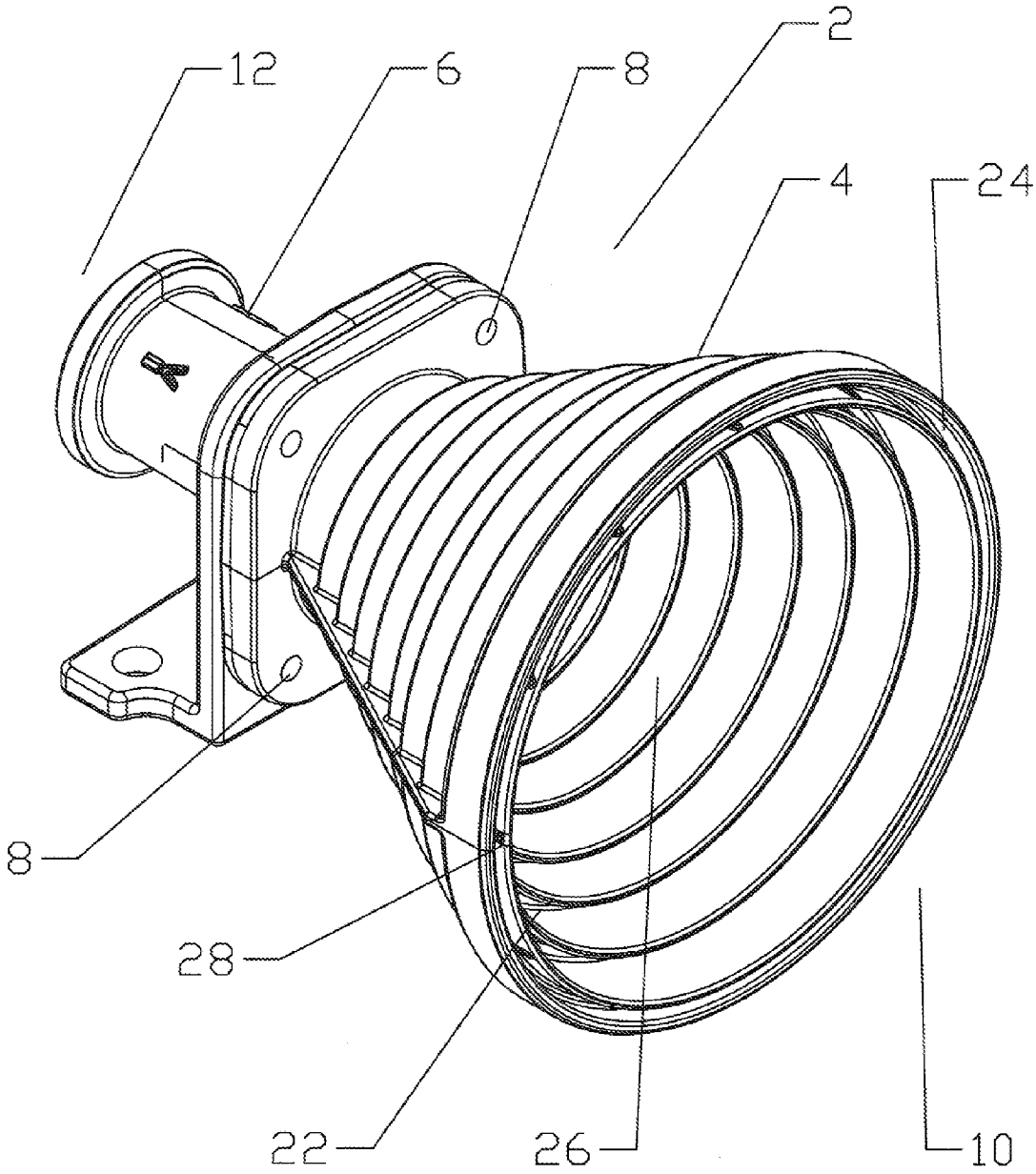
FIG. 1 is a schematic isometric angled view of an exemplary feed horn embodiment.

As shown in FIG. 1, an exemplary embodiment of the feed horn 2 has a horn body 4 and a waveguide body 6 coupled together with coaxial bores described herein below, for example, via a plurality of fasteners (removed for clarity) such as threaded screws, clips or bolts passing through fastener hole(s) 8. Alternatively, the horn body 4 and waveguide body 6 may be permanently coupled for example via adhesive, welding or interference fit, depending on the selected material(s). Features of the horn body 4 and the waveguide body 6 are described with respect to front and back ends 10, 12 of each, the front end 10 of the waveguide body 6 coupled to the back end 12 of the horn body 4.

Figure 2:
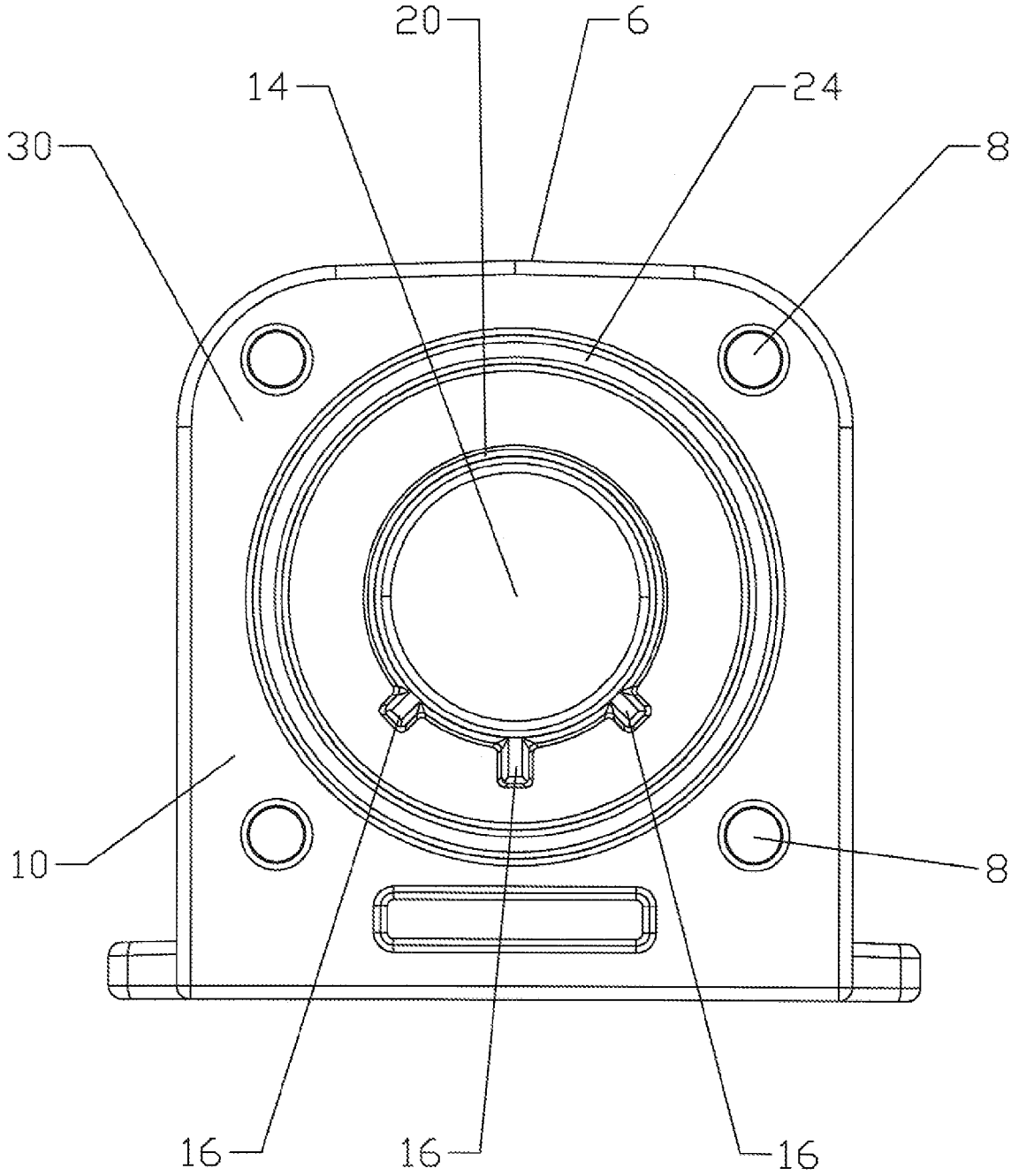
FIG. 2 is a schematic front end view of the waveguide body of FIG. 1.

As shown in FIG. 2, to compensate for cross polarization interference inherent in an offset reflector antenna configuration, the waveguide body 6 has a waveguide bore 14 with at least one compensation slot 16 formed in the waveguide bore 14 sidewall 18. The slot(s) 16 may be formed in a compensation portion 20 of the waveguide bore 14 that extends to the front end 10. The compensation portion 20 is demonstrated as having a diameter that is greater than the diameter of a waveguide bore 14 that extends to the back end 12, the diameter selected to allow TE21 to propagate freely at the desired operating frequency. To improve mold separation during manufacture via die casting, the compensation portion 20 may be formed with a taper that increases the diameter towards the front end 10. Similarly, a depth and width of the slot(s) 16 may be formed with a taper that increases towards the front end 10. Descriptions herein of generally parallel, with respect to tapered features is interpreted with respect to a centerline and or untapered construction line related to such tapered features being otherwise parallel with the identified axis, but for the slight taper applied.

Figure 4:
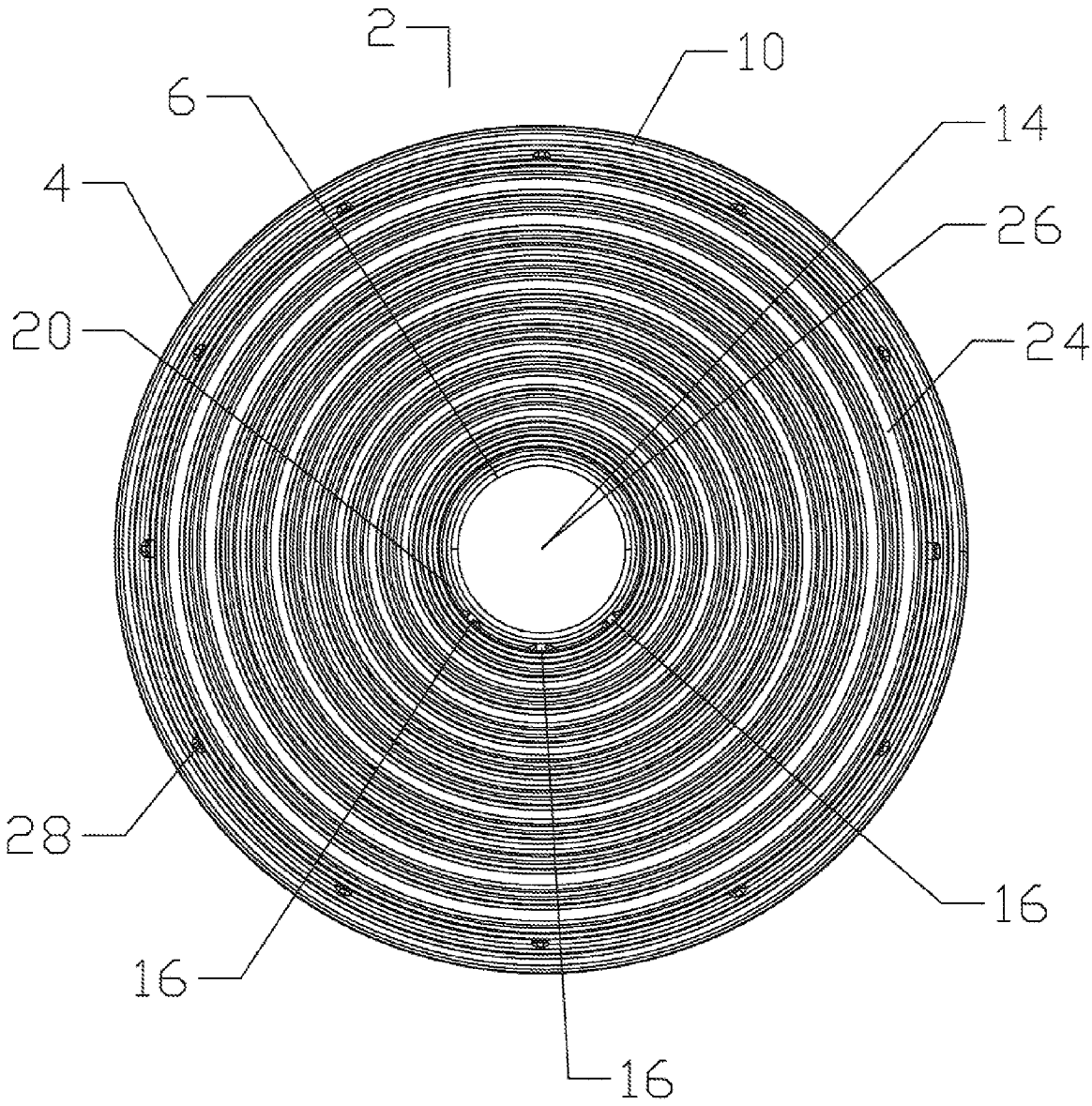
FIG. 4 is schematic front view of FIG. 1.

FIGS. 1, 2 and 4 demonstrate an embodiment with three slot(s) 16. Specific dimensions for the slot(s) 16 are derived based upon the waveguide bore 14 dimensions and the desired operating frequency of the feed horn 2, selected to excite a TE21 mode in the waveguide body 6 operative to cancel the cross polar interference. In the exemplary embodiment, the center slot excites a TE21 mode selected to provide cancellation of cross polarization when the antenna is operated with horizontal polarization. Similarly, two secondary slot(s) 16 are arranged one each at 45 degrees to either side of the primary slot 16, each of the slot(s) 16 generally parallel to a longitudinal axis of the waveguide bore 14, and extending to the front end 10 of the waveguide body 6. The secondary slot(s) 16 are operative to excite a TE21 mode which provides cancellation of cross-polarization when the antenna is operated with vertical polarization. For circular polarization, which is composed of equal amplitudes of orthogonal vertical and horizontal field components phased apart by 90°, the slots work to excite a TE21 mode for each signal component as described for the linear polarization case(s). The component summation then provides the desired interference cancellation effect.

Because the slot(s) 16 are open to the front end 10, they may be formed with any desired length, depth and width to match the corresponding bore 14 diameter and operating frequency parameters without introducing overhanging edges along the longitudinal axis.

Figure 3:
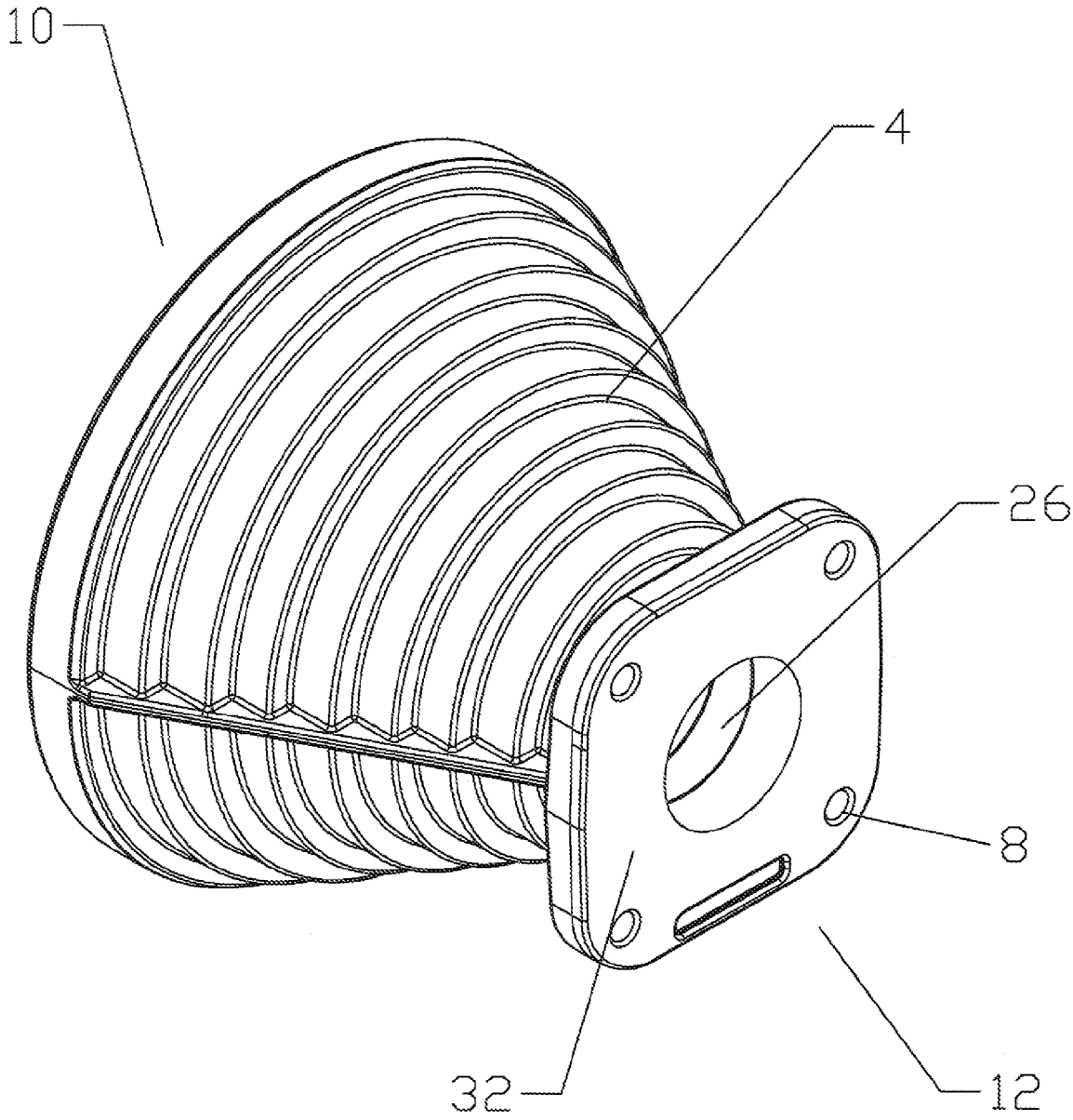
FIG. 3 is a schematic isometric angled back view of the horn body of FIG. 1.

As best shown in FIGS. 1, 3 and 4, the horn body 4 is demonstrated with a plurality of successively larger diameter step(s) 22 having corrugations formed via annular groove(s) 24 of the step(s) 22 that are open to the front end 10 of the horn body 4. The step(s) 22 increase the diameter of a horn bore 26 from the back end 12 to the front end 10, the corrugations adapted to provide radiation characteristics optimized for the selected antenna optic design. The horn step(s) 22 may be formed as concentric circles and or ellipses, for example to match the beam characteristics generated by the selected shape of the main reflector and or other optics the feed assembly is mated with. Protrusion(s) 28 may be formed spaced around the annular groove(s) 24, for example at a front end 10 step 22 to provide friction retaining surfaces for a horn cover/radome. To allow feeds with parallel longitudinal axis to have a small directional offset, for example applied offset from the centerline of the straight line beam path to link with a signal to/from another target satellite in proximity orbit via a second feed horn 2 offset from the primary feed horn 2, the step(s) 22 and corrugations may be formed in a squint or slanted planar orientation, that is in a plane other than normal to the longitudinal axis of the feed horn 2.

As best shown in FIG. 4, the horn bore 26 at the back end 12 has a diameter selected to prevent or at least degrade the TE21 mode excited by the slot(s) 16 from propagating back to the connection port, and therefore interfering with attached equipment. The diameter is small enough to close at least a portion of the minimum depth of the slot(s) from front end 10 exposure when the horn body 4 is coupled to the waveguide body 6. The horn bore 26 between the horn body 4 back end 12 and the first step, in cooperation with the body bore 14 between the compensation portion 20 and the back end 12 of the waveguide body 6, each have a length selected to control the phase of the TE21 and TE11 fundamental mode therein.

Further, because the slot(s) 16 are fully contained within the waveguide body 6, the step 22 widths of the horn body 6 are not limited or constrained by desired slot 16 depths. Thus the first step of the horn bore 26 may be provided with a step 22 width that is less than a depth of the slot(s) 16 and the horn bore 26 formed with a diameter at the back end 12 equal to or less than the waveguide bore 14 at the front end 10.

The various dimension selections are also made in view of the other antenna optics, such as the main reflector and or sub reflector if present, to provide a complete optic solution with respect to cross-polarization interference cancellation and signal phasing.

Both the horn body 4 and the waveguide body 6 may be dimensioned for manufacture via die casting, injection molding, thixotropic molding, metal injection molding or the like without overhanging edges for mold separation along the longitudinal and transverse dimensions. The separate horn and waveguide body(s) 4, 6 may then coupled together via fasteners. A gasket such as an o-ring (not shown for clarity) may be placed in an annular groove 24 formed in the front face 30 of the waveguide body 4 and or the back face 32 of the horn body 6 to environmentally seal the joint between the horn body 6 and the waveguide body 4. Alternatively, a monolithic embodiment may be achieved by overmolding, for example forming the horn body 4 upon a pre-formed waveguide body 6 or vice versa.

From the foregoing, it will be apparent that the present invention brings to the art a feed horn 2 with improved electrical performance and significant manufacturing cost efficiencies. A range of different feed horn embodiments may be quickly assembled from different waveguide and horn body (s) 4, 6 to meet varying main reflector and or operating frequency requirements, significantly reducing inventory costs. Alternative embodiments may be cost effectively prepared by fabrication only of the needed molds or mold portions. For example, the slot(s) 16 configuration of a selected waveguide body 4 may be modified by preparing only an alternate longitudinal axis portion of the waveguide body 4 mold(s).

Table of Parts

| | |
|---|---|
| 2 | feed horn |
| 4 | horn body |

-continued

Table of Parts

| | |
|---|---|
| 6 | waveguide body |
| 8 | fastener hole |
| 10 | front end |
| 12 | back end |
| 14 | waveguide bore |
| 16 | slot |
| 18 | sidewall |
| 20 | compensation portion |
| 22 | step |
| 24 | annular groove |
| 26 | horn bore |
| 28 | protrusion |
| 30 | front face |
| 32 | back face |

Where in the foregoing description reference has been made to ratios, integers, components or modules having known equivalents then such equivalents are herein incorporated as if individually set forth.

Each of the patents identified in this specification are herein incorporated by reference in their entirety to the same extent as if each individual patent was fully set forth herein for all each discloses or if specifically and individually indicated to be incorporated by reference.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A feed horn, comprising:

a horn body and a waveguide body, each with a front end and a back end, respectively;

the horn body and the waveguide body coupled together, the waveguide body front end to the horn body back end;

the waveguide body provided with a waveguide bore between the front end and the back end;

at least one slot formed in a sidewall of the waveguide bore generally parallel to a longitudinal axis of the waveguide bore;

the at least one slot extending to the front end;

the horn body provided with a horn bore between the front end and the back end, the horn bore at the back end provided with a diameter equal to or less than the waveguide bore at the front end, wherein the at least one slot has a depth greater than a first step of the horn bore.

2. The feed horn of claim 1, wherein the horn bore is provided with a plurality of steps increasing a horn bore diameter between the back end and the front end.

3. The feed horn of claim 2, wherein at least one of the steps further includes an annular groove open to the front end.

4. The feed horn of claim 1, wherein the waveguide bore extending to the back end has a smaller diameter than a compensation portion of the waveguide bore extending to the front end.

5. The feed horn of claim 4, wherein the at least one slot is in the compensation portion.

6. The feed horn of claim 1, wherein the at least one slot is a plurality of slots, each generally parallel to the longitudinal axis.

7. The feed horn of claim 1, wherein the horn body and the waveguide body are coupled together by at least one fastener.

8. The feed horn of claim 1, wherein the horn body and the waveguide body are coupled together with the body bore coaxial with the horn bore.

9. A method for manufacturing a feed horn, comprising the steps of:

forming a horn body and a waveguide body, each with a respective front end and a back end;

the waveguide body formed with a waveguide bore between the front end and the back end; at least one slot formed in the waveguide bore extending to the front end, parallel to a longitudinal axis of the waveguide bore; and coupling the horn body and the waveguide body together, the waveguide body front end to the horn body back end, wherein the at least one slot is formed with a depth greater than a first step of the horn bore.

10. The method of claim 9, wherein the horn bore is formed with a diameter at the back end equal to or less than the waveguide bore at the front end.

11. The method of claim 9, wherein the waveguide bore extending to the back end has a smaller diameter than a compensation portion of the waveguide bore extending to the front end.

12. The method of claim 11, wherein the at least one slot is formed in the compensation portion.

13. The method of claim 9, wherein the coupling of the horn body and the waveguide body together is via overmolding either the horn body upon the waveguide body or the waveguide body upon the horn body, creating a monolithic feed horn.

14. The method of claim 9, wherein the waveguide body and the horn body are formed via die casting.

15. The method of claim 9, wherein the waveguide body and the horn body are formed via injection molding.

16. The method of claim 9, wherein the waveguide body and the horn body are formed via thixotropic molding.

17. The method of claim 9, wherein the waveguide body and the horn body are formed via metal injection molding.

* * * * *